US005590892A

United States Patent [19]

Hu

[11] Patent Number: 5,590,892

[45] Date of Patent: Jan. 7, 1997

[54] BABY'S CARRIAGE FOR TEACHING CHILDREN TO WALK

[76] Inventor: Stephen Hu, No. 2, Ta Ton Road, Hsinchu Industrial Area, Hu Kou, Hsinchu, Taiwan

[21] Appl. No.: 396,956

[22] Filed: Mar. 1, 1995

[51] Int. Cl.[6] ..... B62B 9/08

[52] U.S. Cl. ..... 280/87.051; 188/5; 482/66

[58] Field of Search ..... 188/5; 280/87.051, 280/87.021; 482/66, 68, 69, 78; 297/5

[56] References Cited

U.S. PATENT DOCUMENTS

| | | | |
|---|---|---|---|
| 1,277,886 | 9/1918 | Elliman | 188/5 X |
| 2,012,628 | 8/1935 | Howell | 188/5 X |
| 2,308,626 | 1/1943 | Reinholz | 280/87.051 X |
| 2,333,450 | 11/1943 | Staley | 188/5 X |
| 3,554,328 | 1/1971 | Jones | 188/5 |
| 4,302,025 | 11/1981 | Waddell et al. | 188/5 X |
| 4,503,943 | 3/1985 | Tsukui | 188/5 |
| 5,366,231 | 11/1994 | Hung | 280/87.051 |

*Primary Examiner*—Brian L. Johnson
*Assistant Examiner*—Michael Mar
*Attorney, Agent, or Firm*—Beveridge, DeGrandi, Weilacher & Young, L.L.P.

[57] ABSTRACT

A carriage for babies to learn to walk includes an upper plate, a bedrock and supporting poles. It can slide on the ground freely. Brake and slide-resisting equipment have been installed in both sides of the bedrock. The brake and slide-resisting equipment comprises a shaft, a cylinder, and a slide-resisting plate. The shaft enables the slide-resisting plate to move freely in the cylinder. Moreover, the shaft can reach the ground and become fixed. The use of a brake and slide-resisting equipment on one side makes the carriage revolve around the slide-resisting plate shaft.

5 Claims, 11 Drawing Sheets

BABY'S CARRIAGE FOR TEACHING CHILDREN TO WALK

FIELD OF THE INVENTION

This invention is a Baby's Walker carriage for teaching small children to walk which is installed with brake and slide-resisting equipment in two sides of the bedrock. It enables the carriage to turn within the same place.

THE BACKGROUND OF THE INVENTION

A Baby's Walker carriage is the best equipment to help babies learn walking. It contains the dual fun of learning and games. Therefore, it is popular and well-sold. However, because the babies lack mature motor skills, they can not control the movement of the carriage suitably. Besides, the carriage is light and easily movable and slides freely once being pushed gentlely. Hence, the carriage could become out of control and the baby get hurt especially when there are visible dangers and obstacles anywhere i.e. desks, chairs, stairs, slopes and so on. Thus, the chance of getting hurt is high. Therefore it is necessary to improve the safety of Baby's Walker carriages. This issue has been paid more and more attention.

To create a safer baby's walker carriage, there have been a lot of people dedicating research and development, and making many efforts. These improvements are either to separate the feet of the walk-learning riders from the ground or to fix the walk-learning carriage to make it immovable. The former is shown in FIG. 1, it includes a drawable canvas belt (40) attached to the bedrock (30) of the carriage, to separate the baby's feet from the ground. Thus, the baby's feet can not reach the ground and yield friction. Therefore, they can not move the carriage by themselves. Even though this method can improve safety, the canvas (40) can be damaged easily due to the continuous friction with the ground. Furthermore, it is not convenient because babies' feet will be an obstacle when drawing the canvas belt (40). Another improvement is to add fixed equipment to the bedrock (30) of the carriage. The typical way is shown in FIG. 2. The supporting equipment (50) is installed in the bedrock (30). The whole structure could be contracted but needs to be coordinated with the structure redesign of the wheels. When the walk-learning carriage wants to be fixed, the revolving button (31) on the two sides makes the wheels (32) contract upwardly. The carriage is immovable by the ground contacting the supporting equipment (50). In order to support and stabilize the carriage effectively, the supporting equipment (50) must be installed in at least three sides of the bedrock, and the surface area touching the ground has to be sufficiently wide enough for effectiveness to be achieved.

The above mentioned conventional carriages have one weakness in common. That is they still can not stabilize the carriage completely. This is because the babies always shake, jump and stretch the feet to the ground repeatedly when using the carriage. As a result, the walk-learning carriage is shaken and slid. Therefore, danger still exists. The babies will be frightened by the shake in the carriage shown in FIG. 1, as all the wheels still reach the ground and lack slide-resisting equipment. Consequently, even if it is not shaken and unstable, it still can slide smoothly. As to the structure shown in FIG. 2, it will be shaken easily and frighten the kids, moreover, it can still move intermittently because of the shake. Hence, the typical carriage still needs improvement.

THE SUMMARY OF THE INVENTION

The main purpose of this invention is to provide a safe Baby's Walker Carriage. The brake and slide-resisting equipments are installed in two sides of the bedrock of the walk-learning carriage. The brake and slide-resisting equipment comprises a shaft, a cylinder, and incased with a slide-resisting plate. It enables the slide-resisting plate revolve freely about the shaft. The shaft can move up and down, and be fixed. The slide-resisting plate attached at it's distal end extends to the ground. When you do not want the carriage to slide freely, you just turn the revolving button of the brake and slide-resisting equipment on one side and make the slide-resisting plate stretch out and reach the ground. Therefore, the walk-learning carriage can only revolve in the original area and can not move away. Thus, it can safely achieve effectiveness.

The second purpose of this invention is to provide a carriage which combines the safety and pleasure. The brake and slide-resisting equipment in one side fixed on the ground enables the walk-learning carriage turn around the brake and slide-resisting equipment. In the premises of safety, it still enable the babies to learn walking, and have the fun of playing.

DETAILED DESCRIPTION OF THE INVENTION

Figure 1:
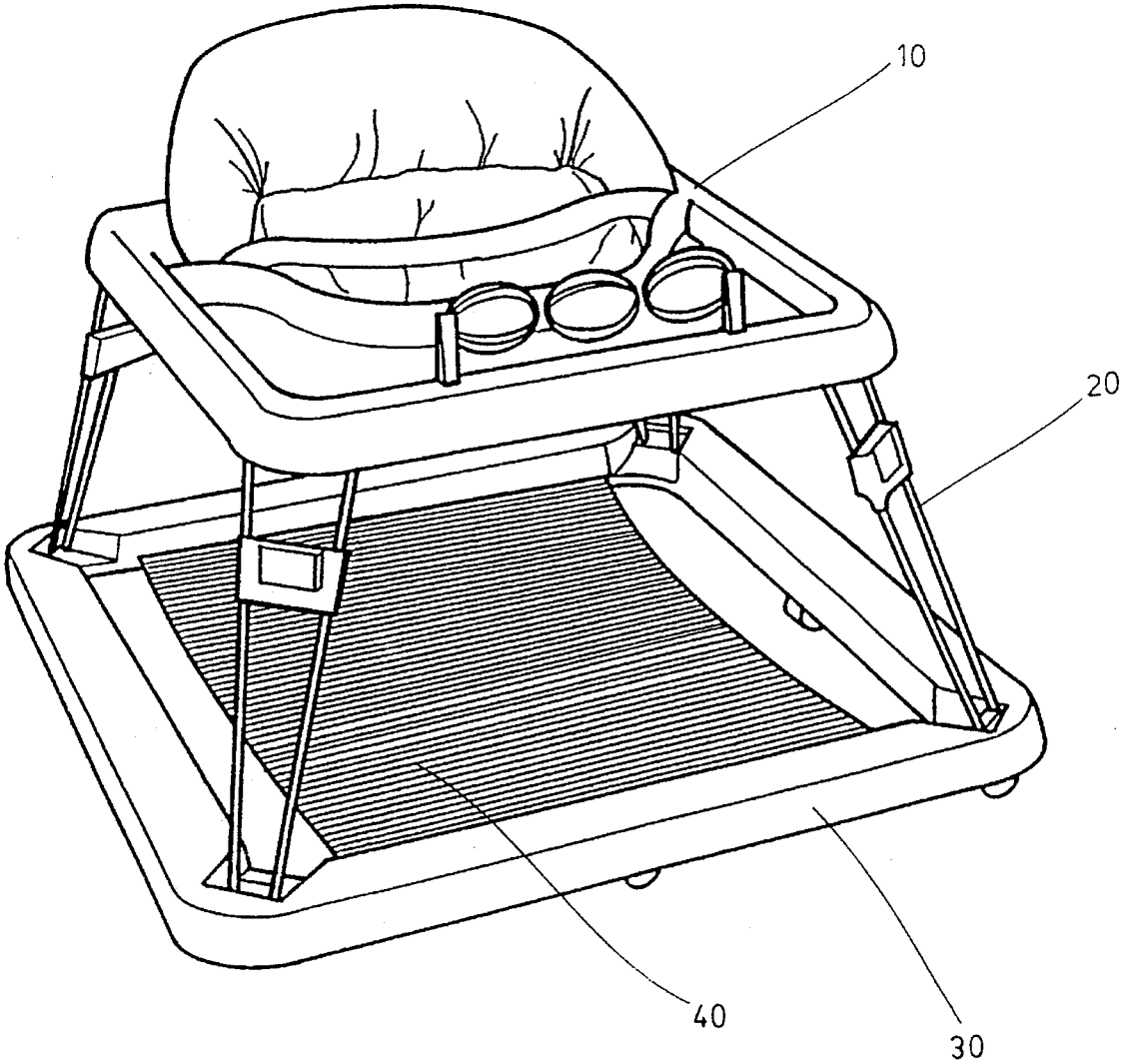
Prior Art FIG 1
FIG. 1 and 2 illustrates a typical prior art baby walker.
Figure 2:
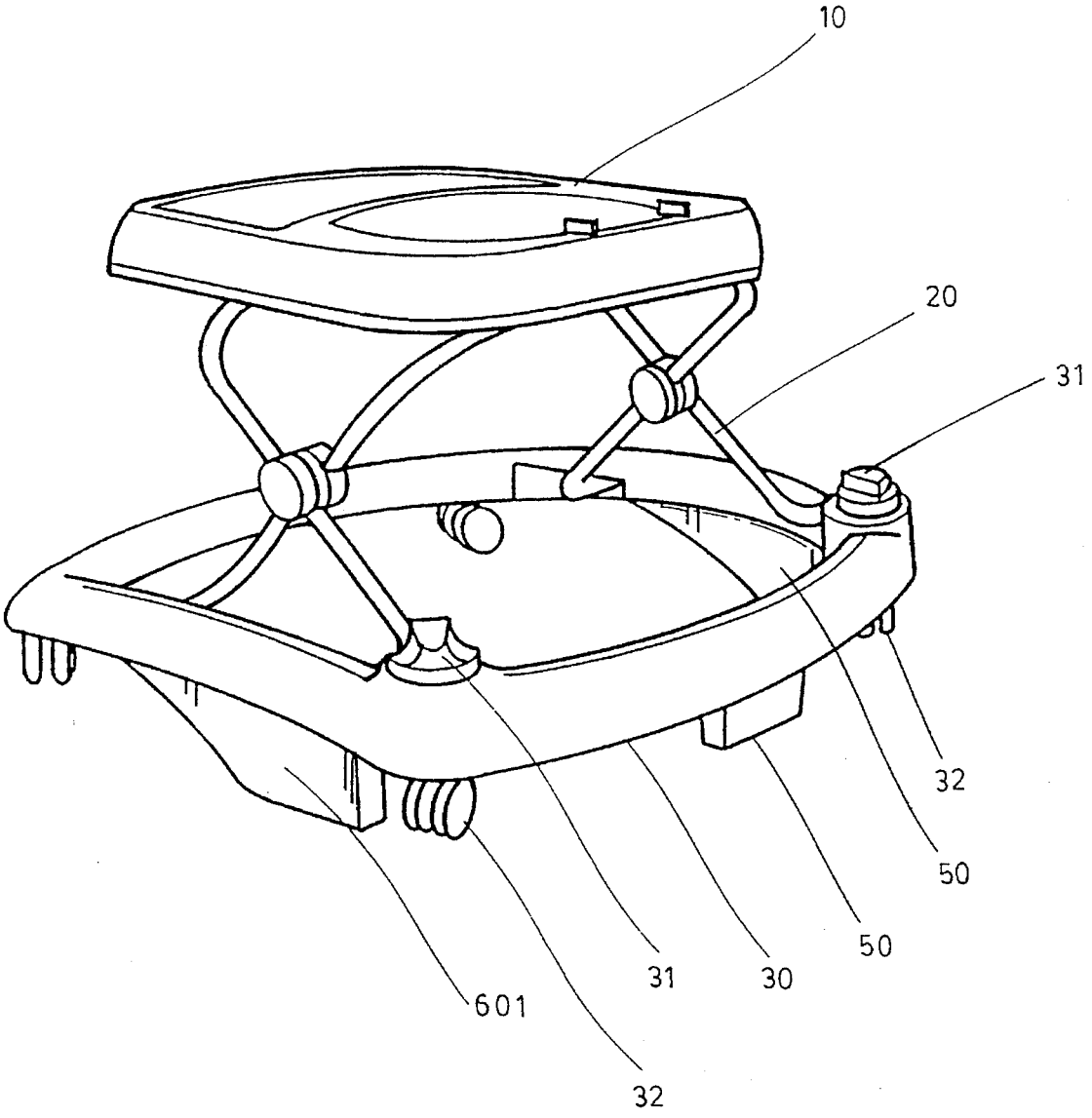
Prior Art FIG 2
Figure 3:
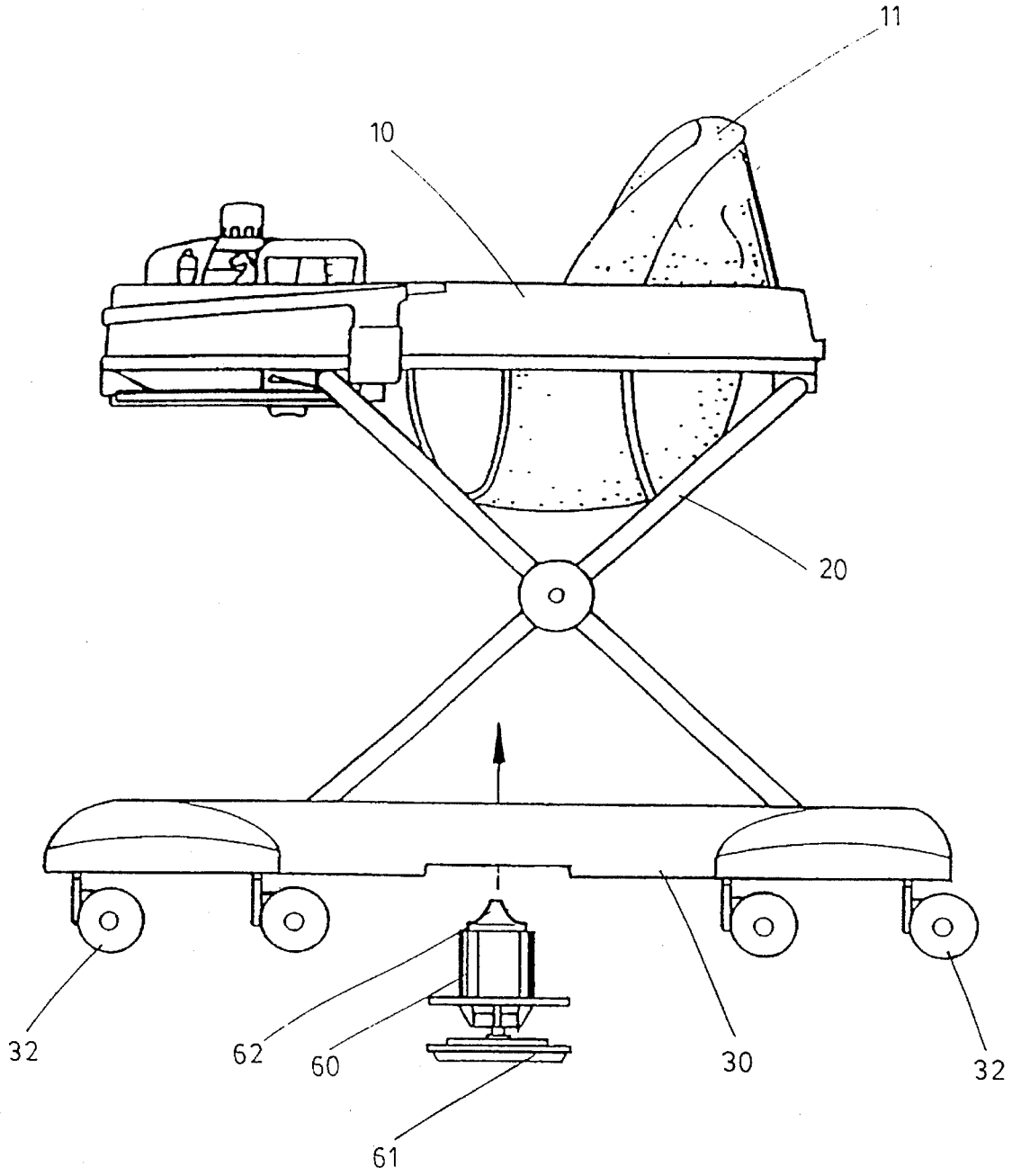
FIG. 3 shows the installation of brake and slide-resisting equipment of the invention.
Figure 4:
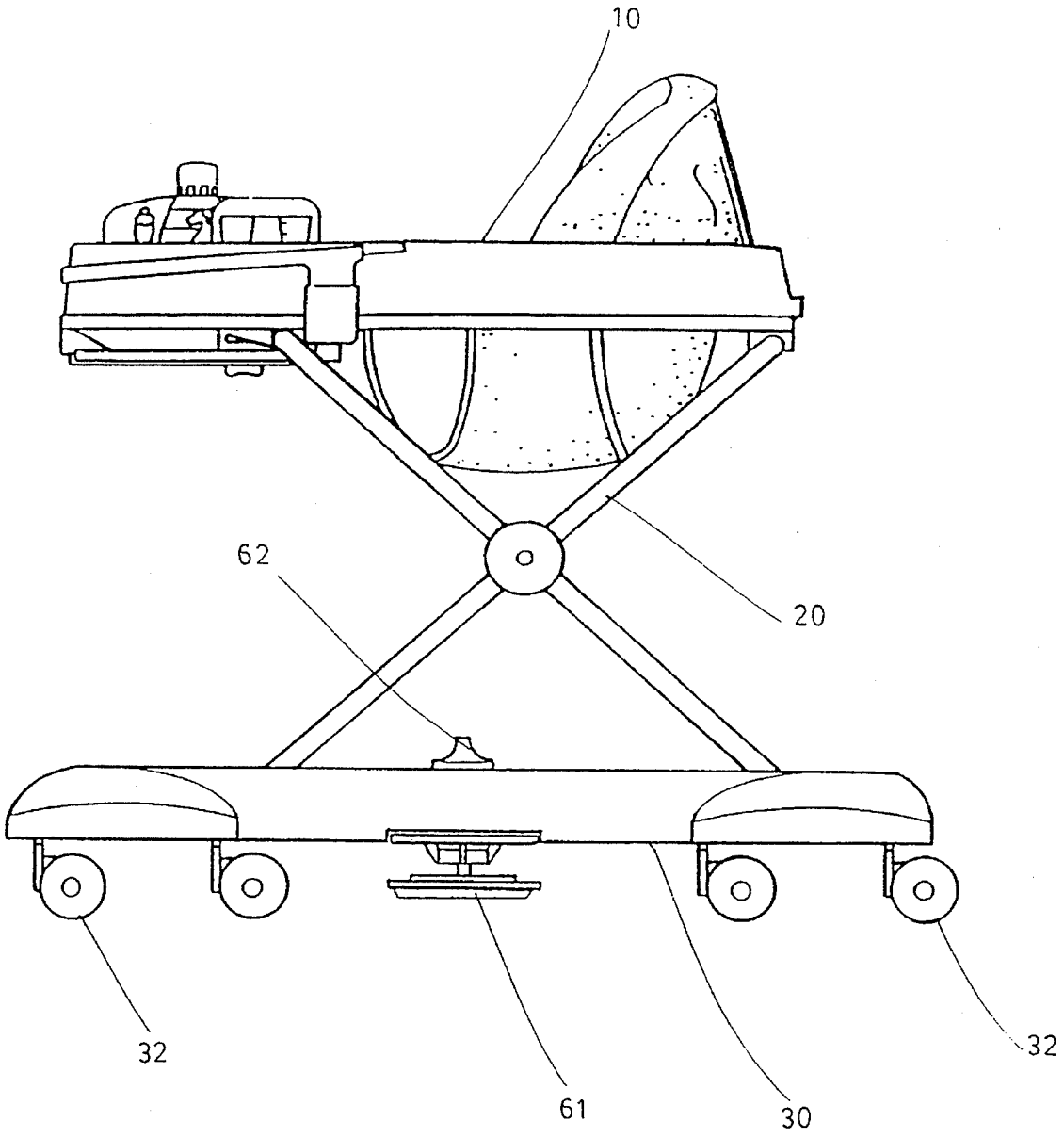
FIG. 4 and 5 illustrate this invention from the side and the front. The brake and slide-resisting equipment are retracted.
Figure 5:
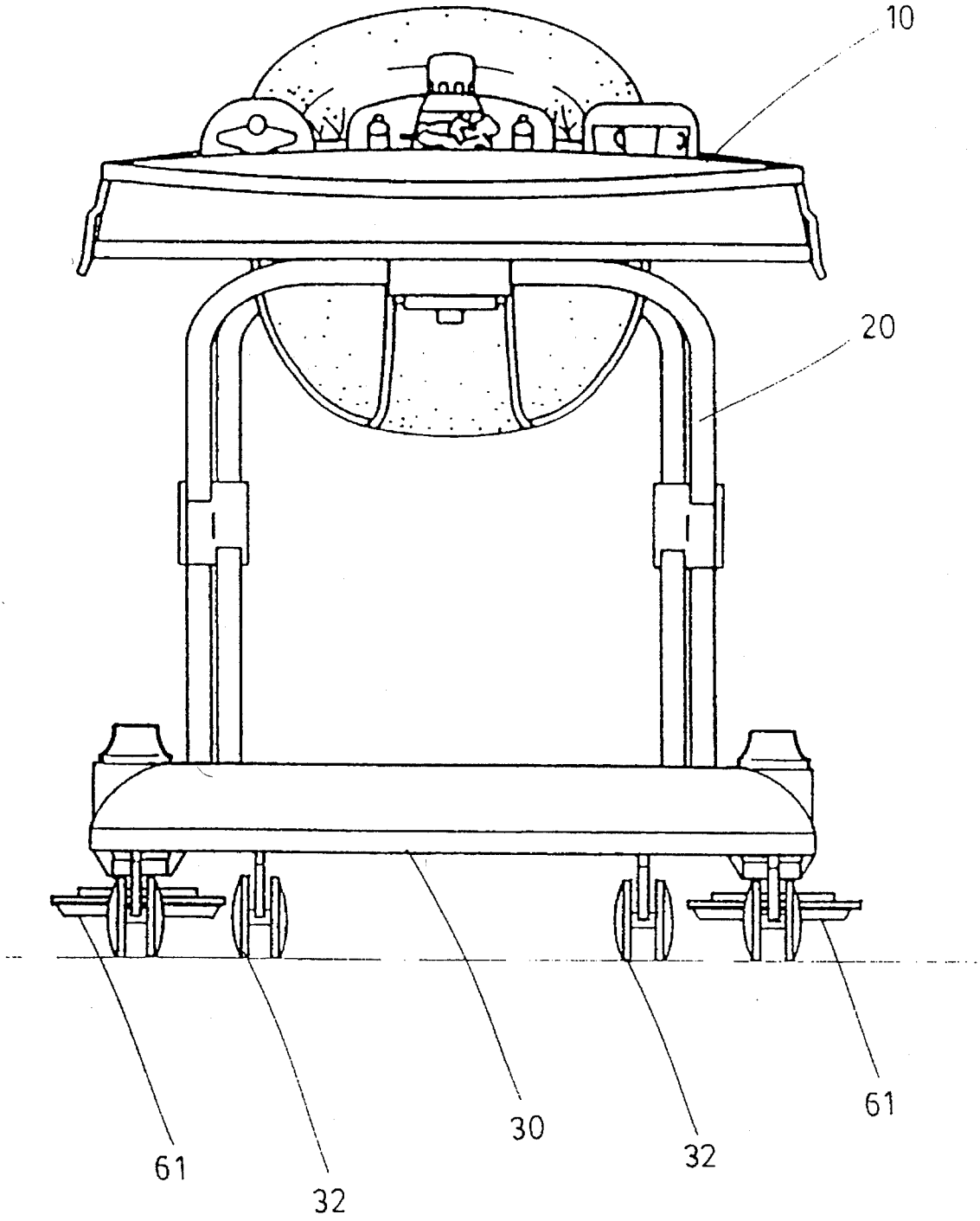

Please refer to the FIG. 3, a Baby's Walker Carriage mainly comprises an upper plate (10) connected to a bedrock (30) by a set of supporting poles (20). The upper plate is equipped with a cushion seat (11) for babies. The bedrock (30) is installed with many wheels (32) allowing children to move freely. The novel features provided by this invention is that the sides of the bedrock (30) of the carriage is equipped with a brake and slide-resisting equipment (60). As shown in FIG. 3, the brake and slide-resisting equipment (60) can be an independent structure, and for easy package and transportation, it can be separated from the carriage before use. The users can press and inlay the equipment by themselves when needed for use. FIG. 4 shows the status after being composed. FIG. 5 is the front view of this invention showing the two sides of the bedrock (30) installed with brake and slide-resisting equipment (60).

Figure 11:
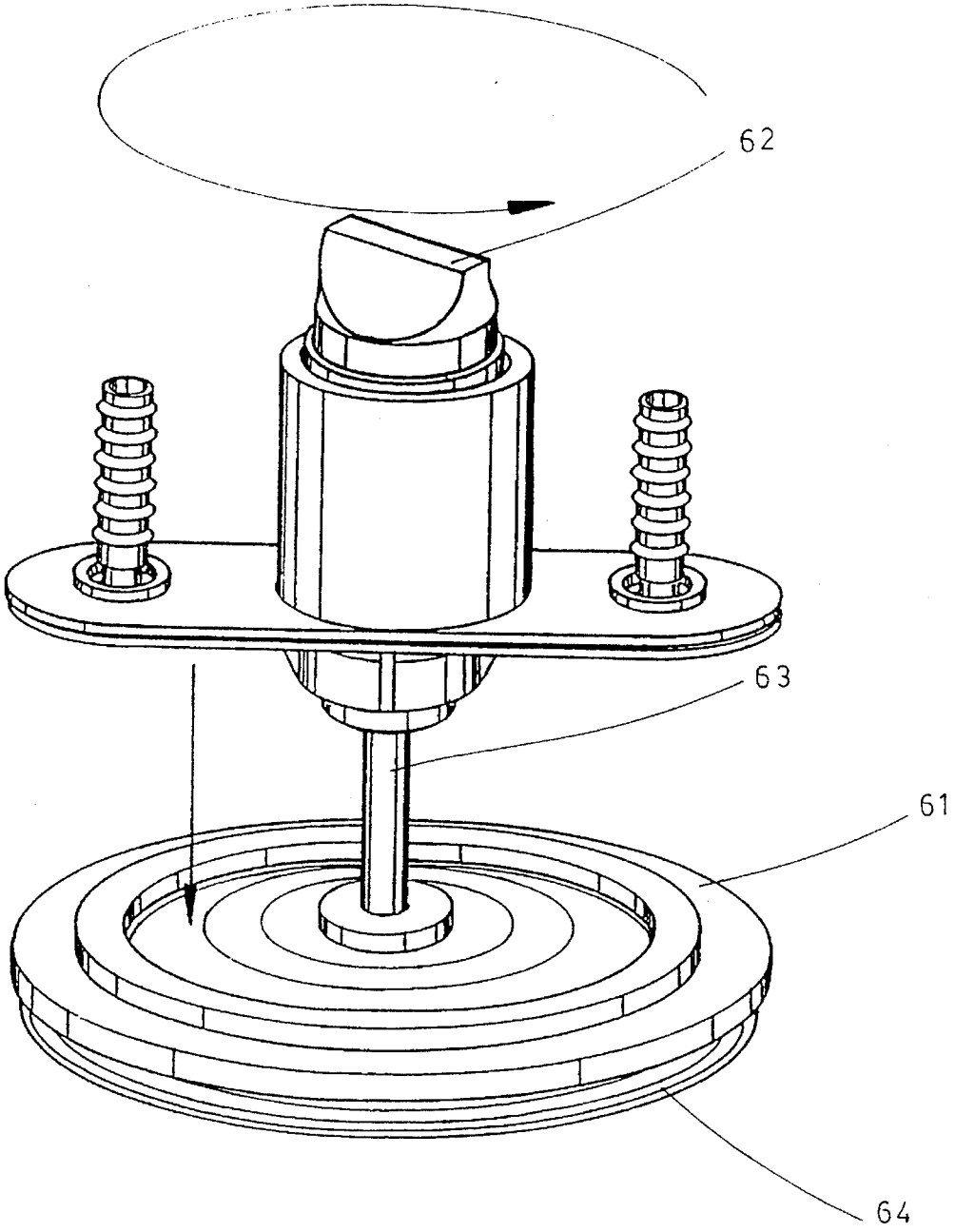
FIG. 11 shows the brake and slide-resisting equipment in isolation.

Please note, the brake and slide-resisting equipment (60) includes a slide-resisting plate (61) and a revolving button (62). FIG. 11 provides a clearer illustration. The slide-resisting plate (61) is fixed on a shaft (63). The button (62) and the shaft (63) are both received within a cylinder which is adapted to be affixed to the bedrock (30). Turning the revolving button (62) can make shaft (63) stretch out or contract back and become fixed. The slide-resisting plate (61) can turned on the shaft (63) freely. Therefore, the brake and slide-resisting equipment itself is a self revolving structure. The slide-resisting plate (64) is fixedly installed with a slide-resisting cushion which is made from latex and has the shape of circle. It offers flexibility and good friction. It effectively immobilizes the carriage when the slide-resisting cushion (64) reaches the ground. However, FIG. 11 is just an example as the brake and slide-resisting equipment (60) can be shown in different kinds of structures and designs. It is not limited within the style shown in any figure.

Figure 6:
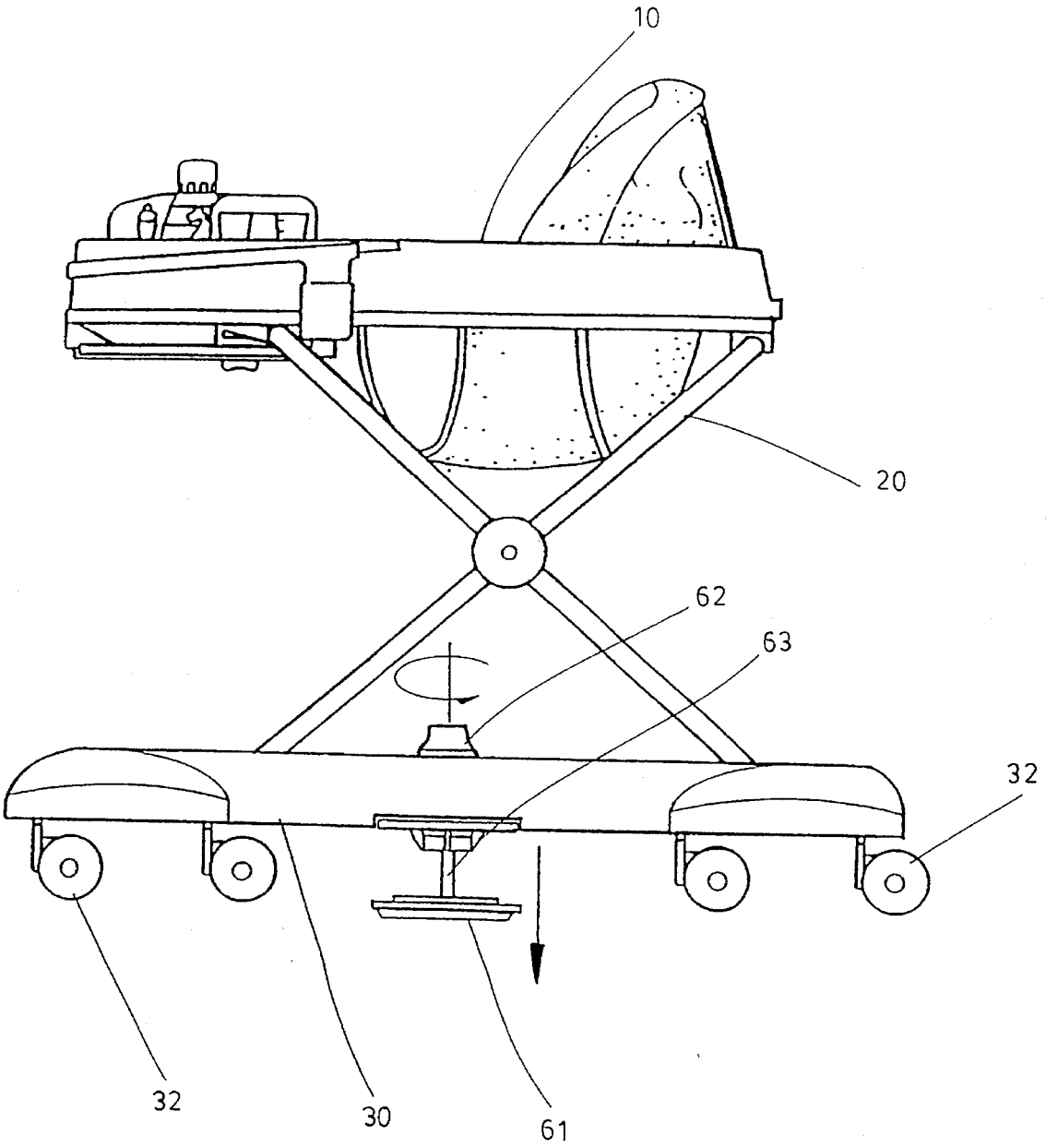
FIGS. 6 and 7 illustrate this invention from the side and the front with the brake and slide-resisting equipment on one side extended to the ground.
Figure 7:
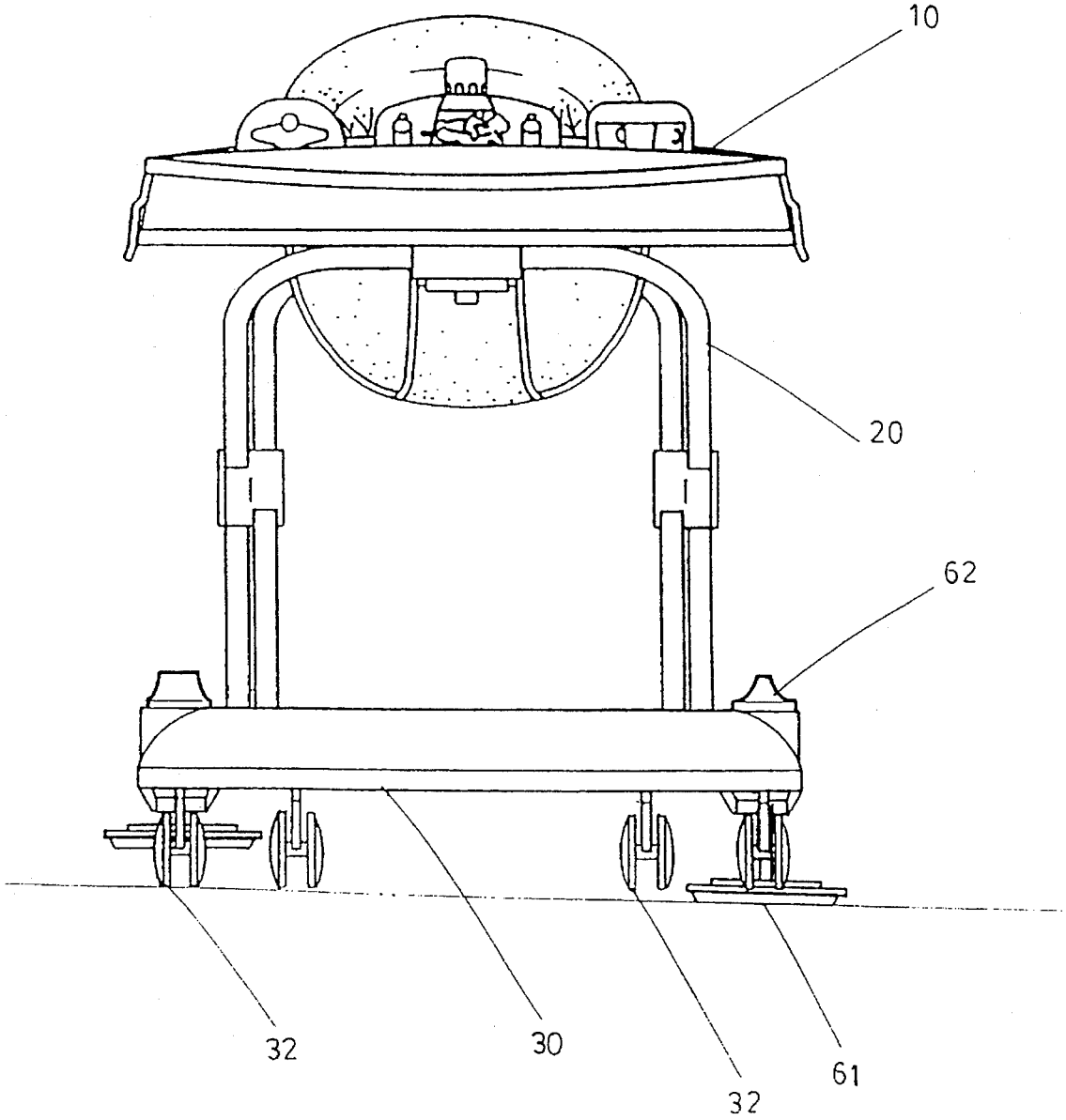

When activating the revolving button (62) on just one side, one shaft extends out and is fixed as shown in FIG. 6. The slide-resisting plate (61) is also pushed out, thus the slide-resisting plate (61) engages the ground as shown in FIG. 7. Now, because the slide-resisting plate (61) fixedly engages the ground, the carriage is prevented from moving away. But the wheels (32) on the other side of the carriage still moves and rolls on the ground freely because, the slide-resisting plate (61) can turn freely on the shaft (63). The use of a single brake and slide-resisting equipment (60) allows the carriage to revolve in the original area. This is shown in FIG. 8 and 9.

Figure 8:
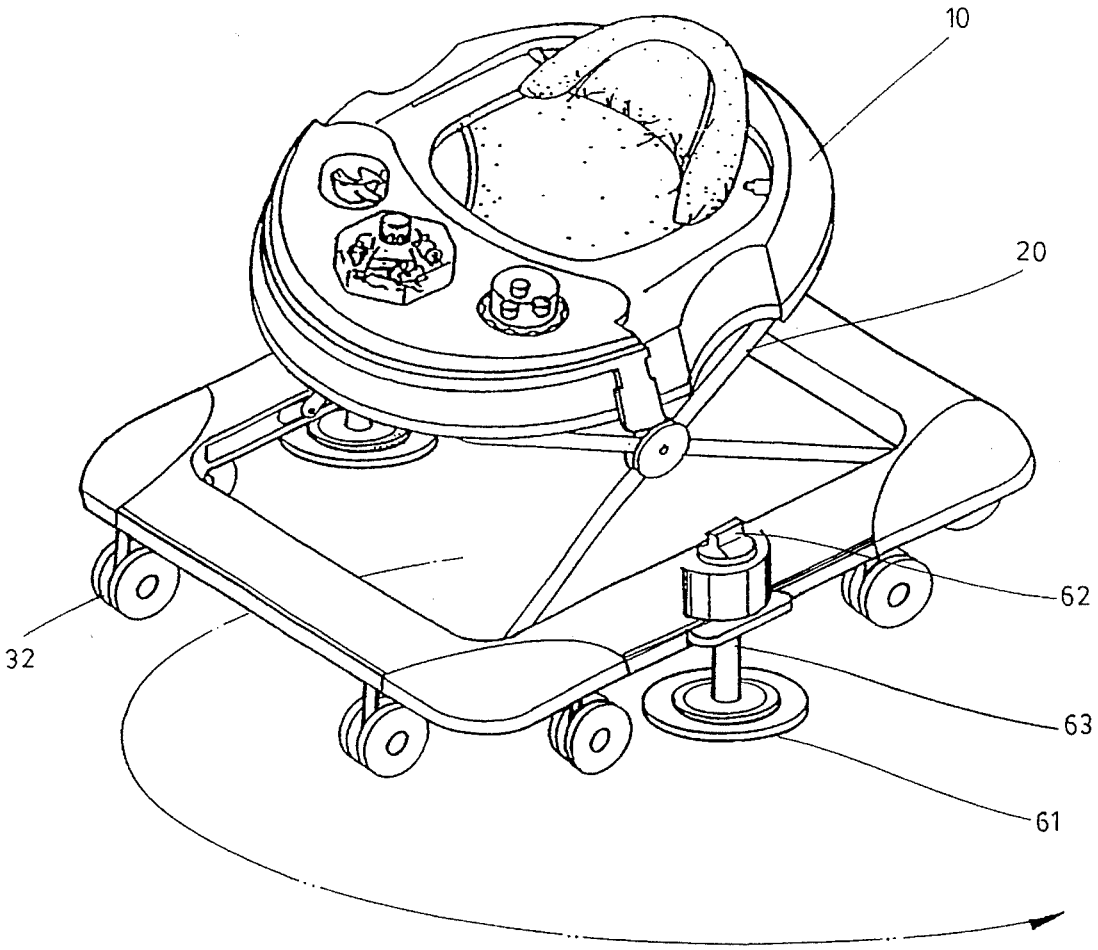
FIGS. 8 and 9 illustrates the operating state of the invention
Figure 9:
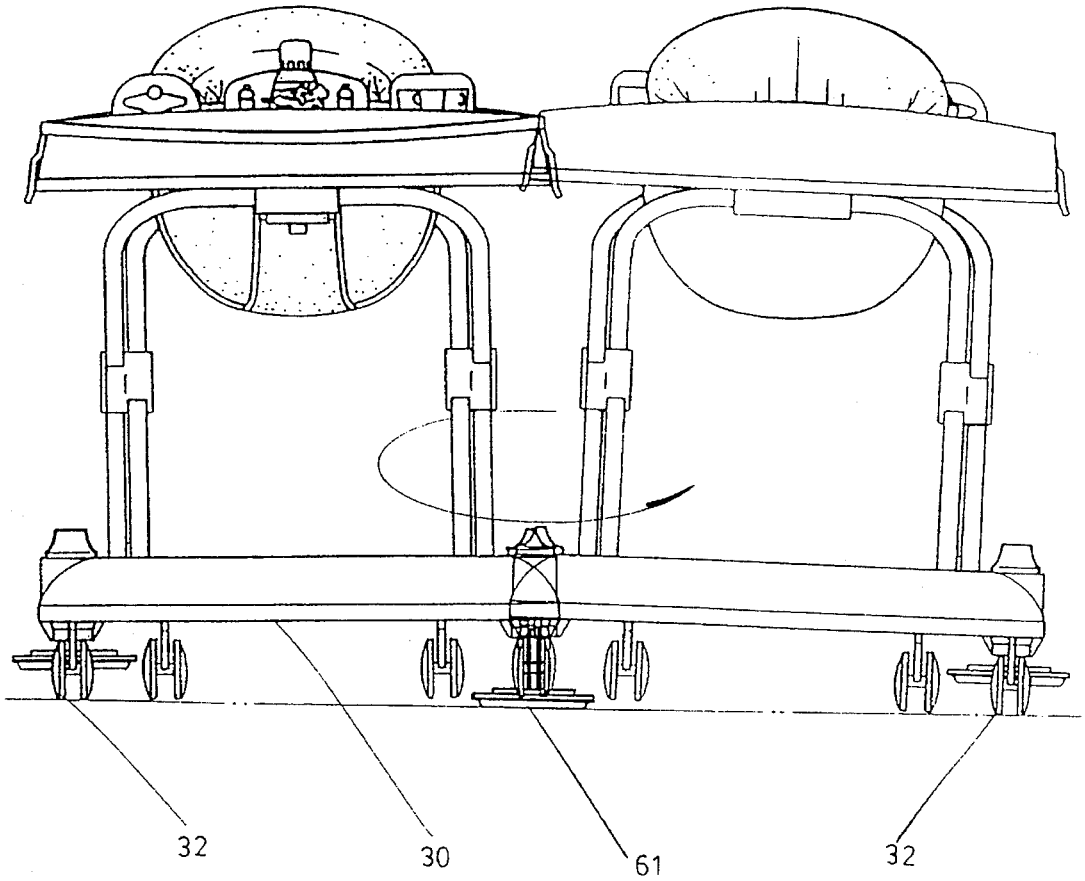

After referring to FIG. 7 to 9, you can find that whenever the riders force the carriage the force will be transferred into the power of pushing the carriage to go around. This is because the one-side brake and slide-resisting equipment (60) prevents the wheels on one side from moving while on the other side can roll freely. Thus, the carriage will not slide away from the original place and is very stable and reliable.

Figure 10:
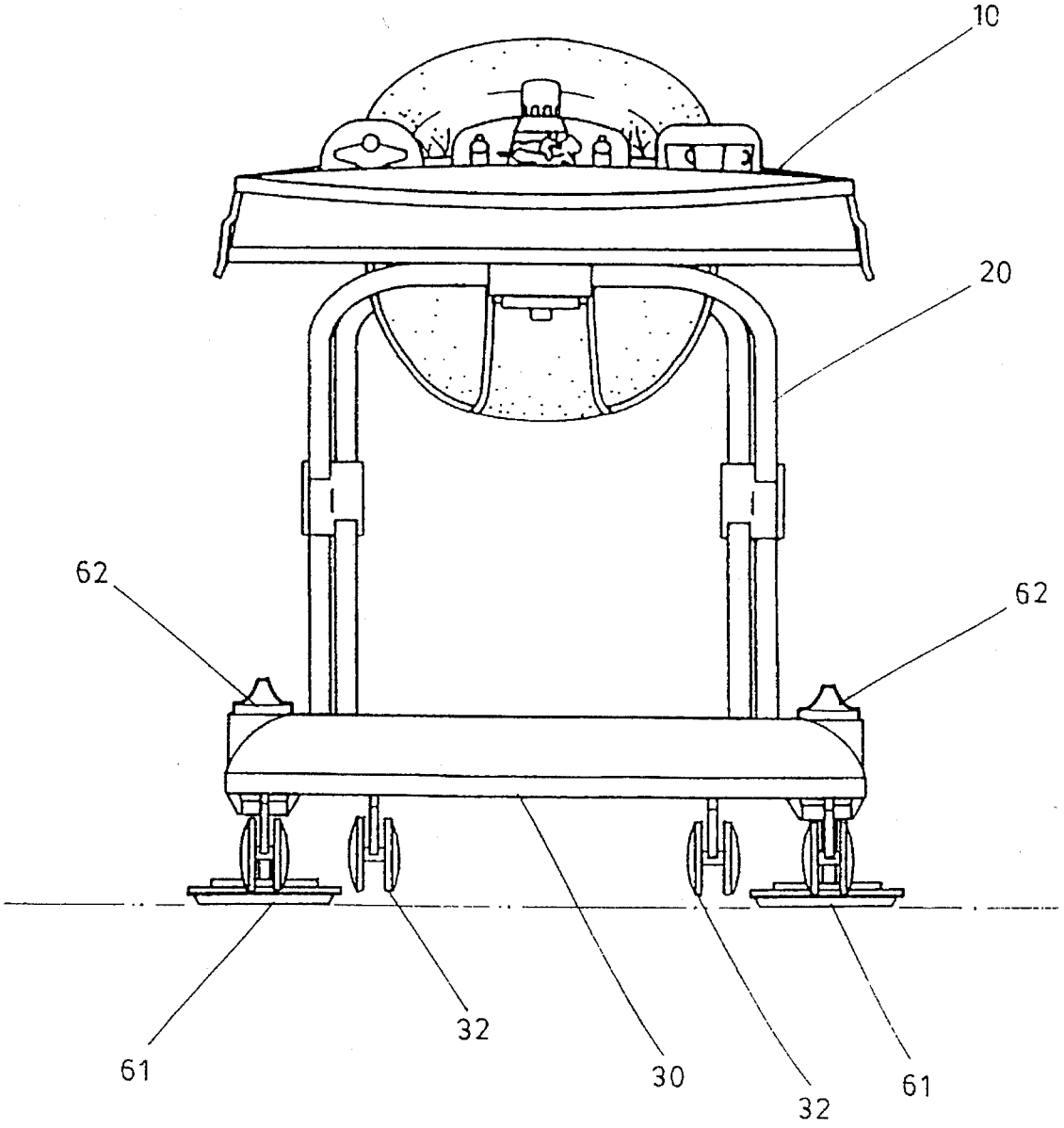
FIG. 10 illustrates this invention with the brake and slide-resisting equipment both extending to the ground.

Through the above mentioned description, this invention can provide a reliable and safe children's carriage, thereby keeping the children learning to walk and play. The original functions of conventional carriages will not be lost. Therefore, the effectiveness of this invention is unique. If the walk-learning carriage needs to be fixed entirely for example, when it is not in use or if the baby is held out of the carriage, the brake and slide-resisting equipment (60) on both sides can be used simultaneously activated as shown in FIG. 10. When the brake and slide-resisting equipment (60) on both sides are fixed to the ground, the walk-learning carriage will stop completely and will not move.

I claim:

1. A carriage for teaching children to walk, comprising:

an upper support member;

a child's seat supported by said upper support member;

a lower support member having a front portion, a rear portion, two opposed lateral portions, and an opening formed therebetween for receiving the feet of a seated child;

at least two support rods for maintaining said upper support member at an elevated position relative to said lower support member;

a plurality of ground engaging wheels affixed to a bottom surface of each one of said opposed lateral portions of said lower support member; and braking and slide-resisting means including a cylinder fixedly secured to one of said opposed lateral portions, a shaft rotatably received within said cylinder and extendible along a vertical axis from a lower end of said cylinder, a control member located at an upper end of said cylinder and rotatable about said vertical axis for extending and retracting said shaft relative to said cylinder, and a ground engageable pad rotatably attached to a lower end of said shaft, wherein said control member is adapted to extend said shaft downwardly to position said pad directly below said one lateral portion and to lift the plurality of wheels of said one lateral portion out of ground engagement, thereby permitting said carriage to rotate about said vertical axis extending through said shaft.

2. A carriage for teaching children to walk as recited in claim 1, wherein:

said braking and slide-resisting means is mounted substantially half-way between a pair of said plurality of ground engaging wheels affixed to said one lateral portion of said lower support member.

3. A carriage for teaching children to walk as recited in claim 1, wherein:

said plurality of ground engaging wheels include wheels affixed to said lower support member in areas where said front, said rear, and said lateral portions are joined together.

4. A carriage for teaching children to walk as recited in claim 1, wherein:

said one lateral portion includes a vertical opening adapted to receive said cylinder for affixing said braking and slide-resisting means thereto.

5. A carriage for teaching children to walk as recited in claim 1, wherein:

said carriage includes a second braking and slide-resisting means affixed to an opposite one of said opposed lateral portions.

* * * * *